US011125473B2

(12) United States Patent
Tamura et al.

(10) Patent No.: US 11,125,473 B2
(45) **Date of Patent: *Sep. 21, 2021**

(54) AIR CONDITIONER

(71) Applicant: FUJITSU GENERAL LIMITED, Kanagawa (JP)

(72) Inventors: Hideya Tamura, Kanagawa (JP); Shinju Watanabe, Kanagawa (JP); Shinya Asano, Kanagawa (JP); Takashi Kimura, Kanagawa (JP); Kotaro Toya, Kanagawa (JP); Yoshiki Tanaka, Kanagawa (JP); Yuki Watanabe, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/485,283

(22) PCT Filed: Feb. 5, 2018

(86) PCT No.: PCT/JP2018/003849

§ 371 (c)(1),
(2) Date: Aug. 12, 2019

(87) PCT Pub. No.: WO2018/147235

PCT Pub. Date: Aug. 16, 2018

(65) Prior Publication Data

US 2019/0376727 A1 Dec. 12, 2019

(30) Foreign Application Priority Data

Feb. 13, 2017 (JP) ..... JP2017-024454

(51) Int. Cl.

| | |
|---|---|
| ***F25B 5/02*** | (2006.01) |
| ***F24F 11/83*** | (2018.01) |
| *F25B 29/00* | (2006.01) |

(52) U.S. Cl.
CPC ..... *F25B 5/02* (2013.01); *F24F 11/83* (2018.01); *F25B 29/003* (2013.01);
(Continued)

(58) Field of Classification Search
CPC ..... F25B 5/02; F25B 29/003; F25B 2313/02334; F25B 2313/0292;
(Continued)

(56) References Cited

U.S. PATENT DOCUMENTS 10,337,769 B2 * 7/2019 Oka ..... F25B 49/02
10,495,331 B2 * 12/2019 Oka ..... G05D 23/1912
(Continued)

FOREIGN PATENT DOCUMENTS

CN 1705852 A 12/2005
CN 101749825 A 6/2010
(Continued)

OTHER PUBLICATIONS

Tokuchi et al., Air Conditioner, Nov. 24, 2016, JP2016196971A, Whole Document (Year: 2016).*
(Continued)

*Primary Examiner* — Larry L Furdge
(74) *Attorney, Agent, or Firm* — Paratus Law Group, PLLC

(57) ABSTRACT

There is provided an air conditioner capable of displaying sufficient cooling ability in each indoor unit by allowing a sufficient amount of refrigerant to flow into indoor units where cooling ability cannot be displayed. By executing refrigerant amount balance control, since degrees of opening of indoor expansion valves are narrowed in indoor units whose refrigerant superheating degrees are smaller than an average refrigerant superheating degree, amounts of refrigerant flowing into the indoor expansion valves are decreased. In the indoor unit where the refrigerant super-
(Continued)

heating degree is higher than the average refrigerant superheating degree, since refrigerant pressure on a downstream side of the indoor expansion valve is also decreased due to the degrees of opening of the indoor expansion valves being narrowed, the difference in pressure between the upstream side and the downstream side of the indoor expansion valve increases and an amount of refrigerant flowing into the indoor unit is increased.

1 Claim, 5 Drawing Sheets

(52) U.S. Cl.
CPC ..... *F25B 2313/0292* (2013.01); *F25B 2313/02334* (2013.01); *F25B 2600/19* (2013.01); *F25B 2600/2513* (2013.01); *F25B 2700/1931* (2013.01)

(58) Field of Classification Search
CPC ..... F25B 2600/19; F25B 2600/2513; F25B 1/00; F25B 13/00; F25B 41/06; F24F 11/83; F24F 11/46; F24F 11/49; F24F 11/84; Y02B 30/70
See application file for complete search history.

(56) References Cited

U.S. PATENT DOCUMENTS

| | | | | |
|---|---|---|---|---|
| 2003/0070441 | A1 | 4/2003 | Moon et al. | |
| 2011/0023534 | A1* | 2/2011 | Kasahara | F25B 13/00 62/498 |
| 2013/0019622 | A1* | 1/2013 | Nakashima | F25B 13/00 62/160 |
| 2017/0198943 | A1* | 7/2017 | Oka | F25B 13/00 |
| 2017/0198956 | A1 | 7/2017 | Luo et al. | |

FOREIGN PATENT DOCUMENTS

| | | | | |
|---|---|---|---|---|
| CN | 103982987 | A | | 8/2014 |
| CN | 104748426 | A | | 7/2015 |
| CN | 105115199 | A | | 12/2015 |
| EP | 3267129 | A1 | | 1/2018 |
| GB | 2274930 | A | | 8/1994 |
| JP | S62-006675 | U | | 1/1987 |
| JP | S63-029159 | A | | 2/1988 |
| JP | H08-049949 | A | | 2/1996 |
| JP | 2002-213798 | A | | 7/2002 |
| JP | 2002213798 | A | * | 7/2002 |
| JP | 2003-536040 | A | | 12/2003 |
| JP | 2005-016782 | A | | 1/2005 |
| JP | 2009-115384 | A | | 5/2009 |
| JP | 2016196971 | A | * | 11/2016 |

OTHER PUBLICATIONS

Shibata, Air Conditioner, Jul. 31, 2002, JP2002213798A, Whole Document (Year: 2002).*
Apr. 3, 2018, International Search Report issued for related PCT Application No. PCT/JP2018/003849.
Apr. 3, 2018, International Search Opinion issued for related PCT Application No. PCT/JP2018/003849.
Jul. 1, 2020, Chinese Office Action issued for related CN application No. 201880011364.6.
Nov. 24, 2020, European Search Report issued for related EP Application No. 18750971.6.

* cited by examiner

AIR CONDITIONER

CROSS REFERENCE TO PRIOR APPLICATION

This application is a National Stage Patent Application of PCT International Patent Application No. PCT/JP2018/003849 (filed on Feb. 5, 2018) under 35 U.S.C. § 371, which claims priority to Japanese Patent Application No. 2017-024454 (filed on Feb. 13, 2017), which are all hereby incorporated by reference in their entirety.

TECHNICAL FIELD

The present invention relates to an air conditioner where a plurality of indoor units are connected to at least one outdoor unit by refrigerant pipes.

BACKGROUND ART

In the related art, when cooling operation is performed in an air conditioner where a plurality of indoor units are connected to at least one outdoor unit by a liquid pipe and a gas pipe, a degree of opening of an expansion valve corresponding to each indoor unit is adjusted such that a refrigerant superheating degree on a refrigerant exit side of the indoor heat exchanger of each indoor unit functioning as an evaporator becomes a predetermined reference value (for example, 2 deg.) (for example, see Patent Literature 1).

Specifically, for each indoor unit, a refrigerant temperature (hereinafter, described as a heat exchange entrance temperature) at a refrigerant entrance side of the indoor heat exchanger and a refrigerant temperature (hereinafter, described as a heat exchange exit temperature) at the refrigerant exit side of the indoor heat exchanger are detected, and the heat exchange entrance temperature is subtracted from the heat exchange exit temperature to determine refrigerant superheating degrees of the indoor units.

Then, the degrees of opening of the expansion valves corresponding to the indoor units are adjusted such that the obtained refrigerant superheating degrees of the indoor units become the above-described reference value. Specifically, when the refrigerant superheating degree obtained at a certain indoor unit is greater than the reference value, the degree of opening of the expansion valve corresponding to the indoor unit is increased. By increasing the degree of opening of the expansion valve, the amount of refrigerant flowing into the indoor heat exchanger of the indoor unit increases and the refrigerant superheating degree decreases. On the other hand, when the refrigerant superheating degree obtained at a certain indoor unit is smaller than the reference value, the degree of opening of the expansion valve corresponding to the indoor unit is decreased. By decreasing the degree of opening of the expansion valve, the amount of refrigerant flowing into the indoor heat exchanger of the indoor unit decreases and the refrigerant superheating degree increases.

CITATION LIST

Patent Literature

Patent Literature 1: JP-A-S63-29159

SUMMARY OF INVENTION

Technical Problem

When cooling operation is performed by the above-mentioned air conditioner, the amount of refrigerant flowing into a specific indoor unit may be reduced depending on an installation state of the outdoor unit and each indoor unit. For example, if installation locations of the indoor units are higher than an installation location of the outdoor unit, and there is a height difference between the installation positions of the indoor units, since the refrigerant is less likely to flow into the indoor unit installed above, the amount of refrigerant flowing into the indoor unit is smaller than the amounts of refrigerant flowing into the other indoor units. At the time of cooling operation, the refrigerant flowing from the outdoor unit toward each indoor unit is condensed by the outdoor heal exchanger of the outdoor unit to become liquid refrigerant, and this is because the liquid refrigerant must flow to the indoor unit installed above the outdoor unit against gravity.

Further, even if the installation location of each indoor unit and the installation locations of the outdoor units are approximately the same height, if a distance between an indoor unit and the outdoor unit is different, the amount of refrigerant flowing into the indoor unit disposed at a location far from the outdoor unit is smaller than the amount of refrigerant flowing into the indoor unit disposed at a location near the outdoor unit. For the indoor unit installed at a location far from the outdoor unit, since the pressure loss due to the refrigerant pipe is greater than that of other indoor units, the length of the refrigerant pipe connecting the indoor unit to the outdoor unit is longer than that of each refrigerant pipe connecting the other indoor unit to the outdoor unit.

As described above, when the indoor units are installed in such a manner that the amount of refrigerant flowing into a specific indoor unit decreases, in a case where a distance between the indoor unit installed at the highest when the height difference between the indoor units is large (for example, 50 m or more) and the outdoor unit or between an indoor unit installed farthest from the outdoor unit and the outdoor unit is large (for example, 50 m or more), the amount of refrigerant flowing into the indoor unit is significantly decreased, resulting in a shortage of refrigerant, and there is a possibility that the cooling ability required by the user cannot be displayed.

On the other hand, at the time of cooling operation, even when the indoor units are not installed in such a manner that the amount of refrigerant flowing into a specific indoor unit decreases, in a case where the number of indoor units connected to the outdoor unit is large and the sum of rated capacities of the indoor units is greater than the a capacity of the outdoor units, the amount of refrigerant flowing into each indoor unit is small compared with when the total value of the rated capacities of the indoor units is equal to or smaller than the rated capacity of the outdoor unit.

As described above, when the number of indoor units connected to the outdoor unit is large and the total value of the capacities of the indoor units is greater than the capacity of the outdoor unit, in the indoor unit with a large air conditioning load (for example, the room temperature of the room where the indoor unit is installed is a high temperature close to 40° C.), the amount of refrigerant currently flowing in may be insufficient for the amount of refrigerant required to display the cooling capacity required by the user.

When there is an indoor unit where the amount of refrigerant flowing in is insufficient due to the above-described reason at the time of cooling operation and the cooling ability cannot be displayed, the refrigerant superheating degree in the indoor unit is a high value (for example, 8 deg.). At this time, as described in Patent Literature 1, even if the degree of opening of the corresponding expansion valve is increased in order to set the refrigerant superheating degree to the reference value in the indoor unit, because the amount of refrigerant flowing into the indoor unit is insufficient in the first place, the refrigerant superheating degree does not decrease. That is, even if the degree of opening of the expansion valve is increased to set the refrigerant superheating degree to the reference value in the indoor unit, the state in which the cooling ability cannot be displayed cannot be eliminated.

The present invention solves the above-mentioned problem, and an object thereof is to provide an air conditioner capable of displaying sufficient cooling ability at each indoor unit by allowing a sufficient amount of refrigerant to flow into indoor units where cooling ability cannot be displayed.

Solution to Problem

To solve the above-mentioned problem, an air conditioner of the present invention is provided with: an outdoor unit; a plurality of indoor units each of which includes an indoor heat exchanger and an indoor expansion valve; an superheating degree detector which detects a refrigerant superheating degree which is a superheating degree of a refrigerant flowing out from each indoor heat exchanger when each indoor heat exchanger is functioning as an evaporator; and a controller which adjusts degrees of opening of the plurality of indoor expansion valves. The controller executes a refrigerant amount balance control to adjust the degree of opening of each indoor expansion valve such that an average refrigerant superheating degree is obtained by averaging a maximum value and a minimum value of the refrigerant superheating degrees detected by the superheating degree detector, and the refrigerant superheating degree of each indoor unit becomes the average refrigerant superheating degree.

Advantageous Effects of Invention

According to the air conditioner of the present invention configured as described above, by executing the refrigerant amount balance control at the time of cooling operation, since refrigerant is distributed from the indoor units having the sufficient amount of refrigerant to the indoor units having the insufficient amount of refrigerant, it is possible to display sufficient cooling ability in each indoor unit during the cooling operation.

BRIEF DESCRIPTION OF DRAWINGS

FIG. 1A is a refrigerant circuit diagram; and FIG. 1B is a block diagram of an outdoor unit controller and an indoor unit controller.

DESCRIPTION OF EMBODIMENTS

Hereinafter, embodiments of the present invention will be described in detail based on the attached drawings. The embodiments will be described by using as an example an air conditioner where to one outdoor unit installed on the ground, three indoor units installed on the floors of the building, respectively, are connected in parallel and cooling operation or heating operation can be simultaneously performed by all the indoor units in an installation state where the amount of refrigerant flowing into a specific indoor unit during the cooling operation is insufficient. The present invention is not limited to the following embodiments and may be variously modified without departing from the gist of the present invention.

First Embodiment

Figure 1A:
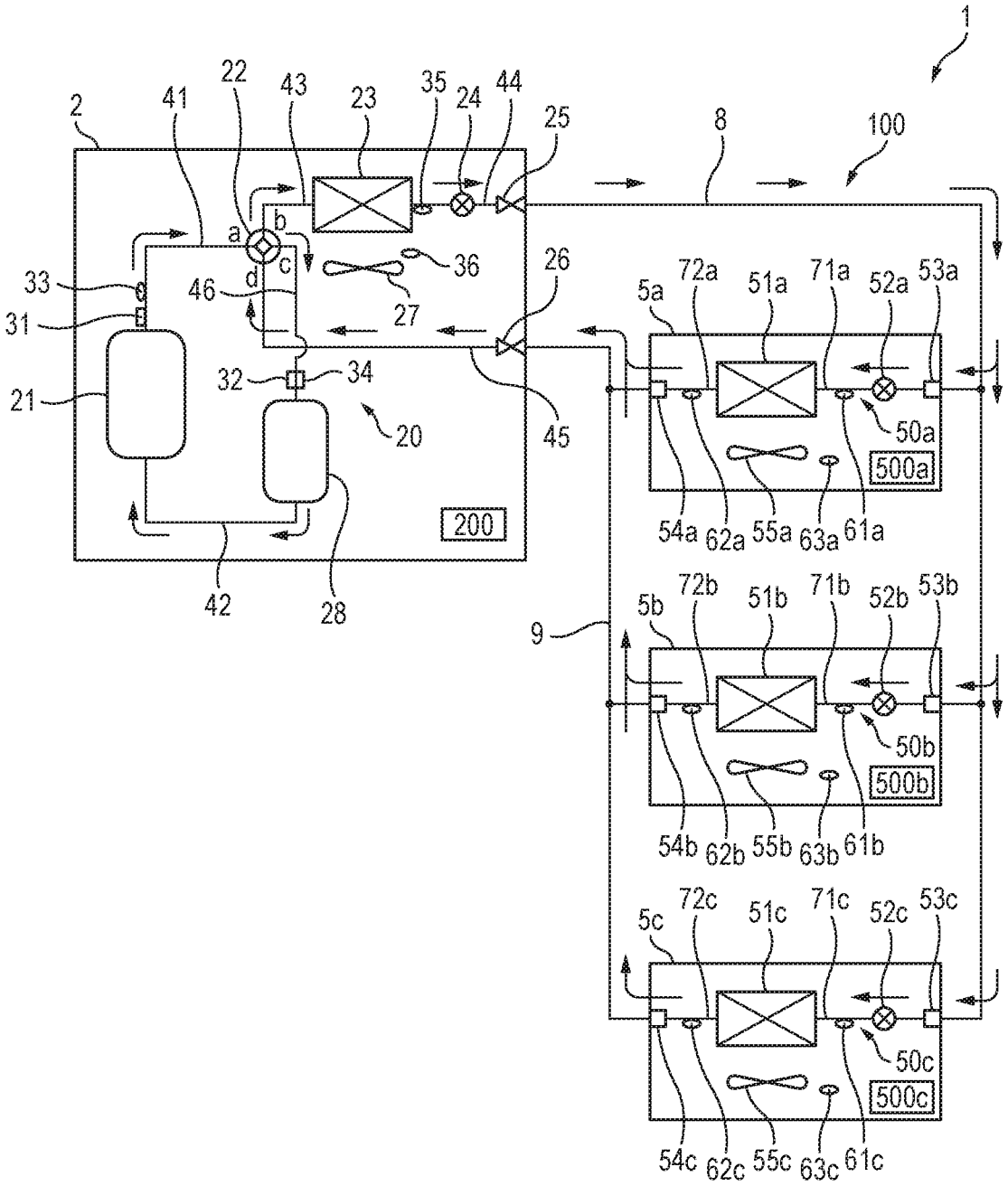
FIGS. 1A and 1B are explanatory diagrams of an air conditioner in an embodiment of the present invention.
Figure 2:
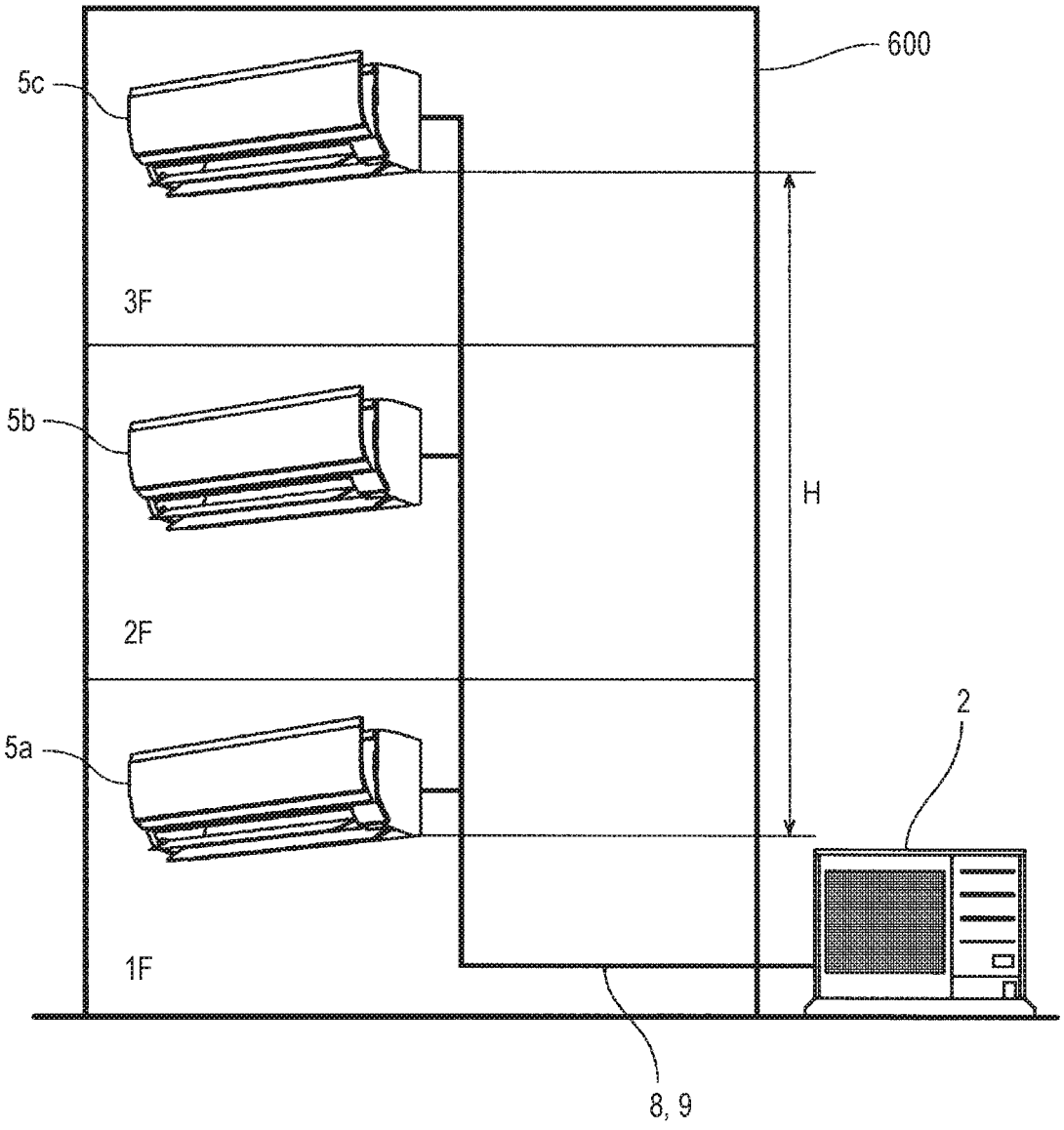
FIG. 2 is an installation diagram of indoor units and an outdoor unit in the embodiment of the present invention.

As shown in FIG. 1A and FIG. 2, an air conditioner 1 of the present embodiment includes one outdoor unit 2 installed on the ground and three indoor units 5*a* to 5*c* installed on the floors of a building 600, respectively, and connected in parallel to the outdoor unit 2 by a liquid pipe 8 and a gas pipe 9. Specifically, the liquid pipe 8 has its one end connected to a closing valve 25 of the outdoor unit 2 and has its other end branched to be connected to liquid pipe connection portions 53*a* to 53*c* of the indoor units 5*a* to 5*c*. The gas pipe 9 has its one end connected to a closing valve 26 of the outdoor unit 2 and has its other end branched to be connected to gas pipe connection portions 54*a* to 54*c* of the indoor units 5*a* to 5*c*. This constitutes a refrigerant circuit 100 of the air conditioner 1.

First, the outdoor unit 2 will be described. The outdoor unit 2 includes a compressor 21, a four-way valve 22, an outdoor heat exchanger 23, an outdoor expansion valve 24, the closing valve 25 to which one end of the liquid pipe 8 is connected, the closing valve 26 to which one end of the gas pipe 9 is connected, an accumulator 28 and an outdoor fan 27. These devices except the outdoor fan 27 are interconnected by refrigerant pipes described below in detail, thereby constituting an outdoor unit refrigerant circuit 20 forming part of the refrigerant circuit 100.

The compressor 21 is a variable ability compressor the operation capacity of which is variable by being driven by a non-illustrated motor the rpm of which is controlled by an inverter. A refrigerant discharge side of the compressor 21 is connected to a port a of the four-way valve 22 described later by a discharge pipe 41, and a refrigerant suction side of the compressor 21 is connected to a refrigerant outflow side of the accumulator 28 by a suction pipe 42.

The four-way valve 22 is a valve for switching the direction in which the refrigerant flows, and is provided with four ports a, b, c and d. The port a is connected to the refrigerant discharge side of the compressor 21 by the discharge pipe 41 as mentioned above. The port b is connected to one refrigerant entrance and exit of the outdoor heat exchanger 23 by a refrigerant pipe 43. The port c is connected to a refrigerant inflow side of the accumulator 28 by a refrigerant pipe 46. The port d is connected to the closing valve 26 by an outdoor unit gas pipe 45.

The outdoor heat exchanger 23 performs heat exchange between the refrigerant and the outside air taken into the outdoor unit 2 by the rotation of the outdoor fan 27 described later. One refrigerant entrance and exit of the outdoor heat exchanger 23 is connected to the port b of the four-way valve 22 by the refrigerant pipe 43 as mentioned above, and the other refrigerant entrance and exit thereof is connected to the closing valve 25 by an outdoor unit liquid pipe 44.

The outdoor expansion valve 24 is provided on the outdoor unit liquid pipe 44. The outdoor expansion valve 24 is an electronic expansion valve, and by the degree of opening thereof being adjusted, the amount of refrigerant flowing into the outdoor heat exchanger 23 or the amount of refrigerant flowing out from the outdoor heat exchanger 23 is adjusted. The degree of opening of the outdoor expansion valve 24 is made full opening when the air conditioner 1 is performing cooling operation. When the air conditioner 1 is performing heating operation, by controlling the degree of opening thereof according to the discharge temperature of the compressor 21 detected by a discharge temperature sensor 33 described later, the discharge temperature is prevented from exceeding a performance upper limit value.

The outdoor fan 27 is made of a resin material, and disposed in the neighborhood of the outdoor heat exchanger 23. The outdoor fan 27 is rotated by a non-illustrated fan motor to thereby take the outside air into the outdoor unit 2 from a non-illustrated inlet, and discharges the outside air heat-exchanged with the refrigerant at the outdoor heat exchanger 23 from a non-illustrated outlet to the outside of the outdoor unit 2.

The accumulator 28, as mentioned above, has its refrigerant inflow side connected to the port c of the four-way valve 22 by the refrigerant pipe 46 and has its refrigerant outflow side connected to the refrigerant suction side of the compressor 21 by the suction pipe 42. The accumulator 28 separates the refrigerant having flown from the refrigerant pipe 46 into the accumulator 28 into a gas refrigerant and a liquid refrigerant and causes only the gas refrigerant to be sucked into the compressor 21.

In addition to the above-described components, various sensors are provided in the outdoor unit 2. As shown in FIG. 1A, the discharge pipe 41 is provided with a discharge pressure sensor 31 that detects the discharge pressure which is the pressure of the refrigerant discharged from the compressor 21 and the discharge temperature sensor 33 that detects the temperature of the refrigerant discharged from the compressor 21. In the neighborhood of the refrigerant inflow port of the accumulator 28 on the refrigerant pipe 46, a suction pressure sensor 32 that detects the pressure of the refrigerant sucked into the compressor 21 and a suction temperature sensor 34 that detects the temperature of the refrigerant sucked into the compressor 21 are provided.

Between the outdoor heat exchanger 23 and the outdoor expansion valve 24 on the outdoor unit liquid pipe 44, a outdoor heat exchange temperature sensor 35 for detecting the temperature of the refrigerant flowing into the outdoor heat exchanger 23 or the temperature of the refrigerant flowing out from the outdoor heat exchanger 23 is provided. In the neighborhood of a non-illustrated inlet of the outdoor unit 2, an outside air temperature sensor 36 that detects the temperature of the outside air flowing into the outdoor unit 2, that is, the outside air temperature is provided.

Figure 1B:
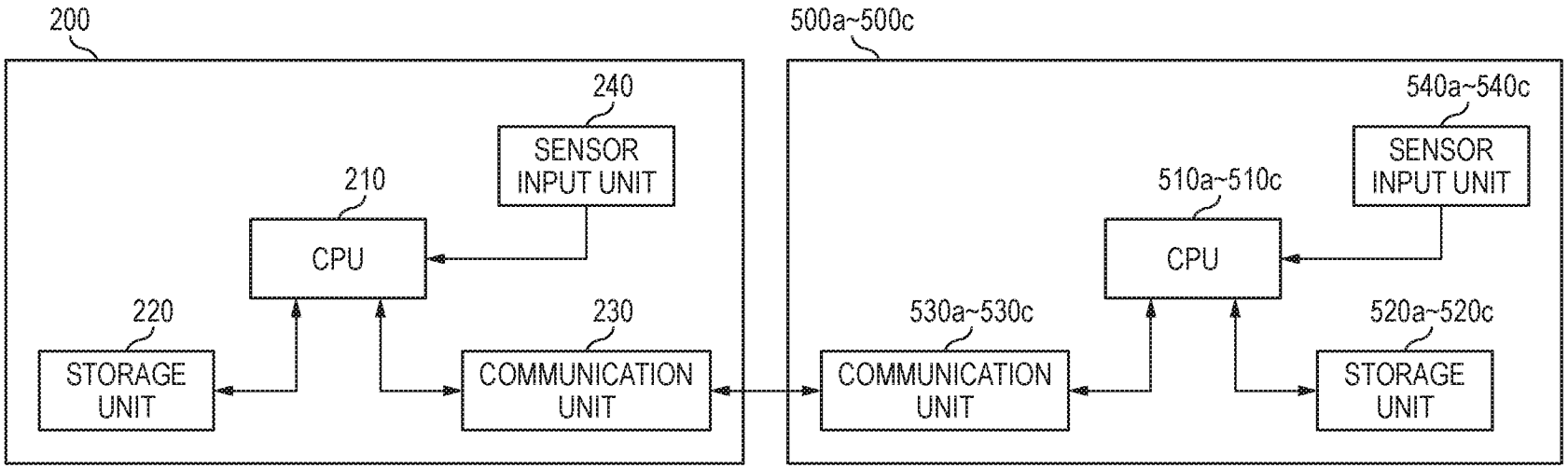

The outdoor unit 2 is provided with an outdoor unit controller 200. The outdoor unit controller 200 is mounted on a control board housed in a non-illustrated electric component box of the outdoor unit 2. As shown in FIG. 1B, the outdoor unit controller 200 includes a CPU 210, a storage unit 220, a communication unit 230 and a sensor input unit 240.

The storage unit 220 is formed of a ROM and a RAM, and stores a control program of the outdoor unit 2, detection values corresponding to detection signals from various sensors, control states of the compressor 21 and the outdoor fan 27, and the like. The communication unit 230 is an interface that performs communication with the indoor units 5*a* to 5*c*. The sensor input unit 240 receives the results of the detections at the sensors of the outdoor unit 2 and outputs them to the CPU 210.

The CPU 210 receives the above-mentioned results of the detections at the sensors of the outdoor unit 2 through the sensor input unit 240. Moreover, the CPU 210 receives the control signals transmitted from the indoor units 5*a* to 5*c* through the communication unit 230. The CPU 210 controls driving of the compressor 21 and the outdoor fan 27 based on the received detection results and control signals. Moreover, the CPU 210 controls switching of the four-way valve 22 based on the received detection results and control signals. Further, the CPU 210 adjusts the degree of opening of the outdoor expansion valve 24 based on the received detection results and control signals.

Next, the three indoor units 5*a* to 5*c* will be described. The three indoor units 5*a* to 5*c* includes indoor heat exchangers 51*a* to 51*c*, indoor expansion valves 52*a* to 52*c*, the liquid pipe connection portions 53*a* to 53*c* to which the other ends of the branched liquid pipe 8 are connected, the gas pipe connection portions 54*a* to 54*c* to which the other ends of the branched gas pipe 9 are connected, and indoor fans 55*a* to 55*c*, respectively. These devices except the indoor fans 55*a* to 55*c* are interconnected by refrigerant pipes described below in detail, thereby constituting indoor unit refrigerant circuits 50*a* to 50*c* forming part of the refrigerant circuit 100. The three indoor units 5*a* to 5*c* all have the same ability, and if refrigerant superheating degree on a refrigerant exit side of the indoor heat exchangers 51*a* to 51*c* at the time of cooling operation can be made not more than a predetermined value (for example, 4 deg.), sufficient cooling ability can be displayed at each indoor unit.

Since the components of the indoor units 5*a* to 5*c* are the same, in the following description, only the components of the indoor unit 5*a* are described, and description of the other indoor units 5*b*, 5*c* is omitted. Moreover, in FIG. 1, the component devices of the indoor units 5*b*, 5*c* corresponding to the component devices of the indoor unit 5*a* are denoted by reference designations where the last letters of the numbers assigned to the component devices of the indoor unit 5*a* are changed from a to b or c, respectively.

The indoor heat exchanger 51*a* performs heat exchange between the refrigerant and the indoor air taken into the indoor unit 5*a* from a non-illustrated inlet by the rotation of the indoor fan 55*a* described later, one refrigerant entrance and exit thereof is connected to the liquid pipe connection portion 53*a* by an indoor unit liquid pipe 71*a*, and the other refrigerant entrance and exit thereof is connected to the gas pipe connection portion 54*a* by an indoor unit gas pipe 72*a*. The indoor heat exchanger 51*a* functions as an evaporator when the indoor unit 5*a* performs cooling operation, and functions as a condenser when the indoor unit 5*a* performs heating operation.

The refrigerant pipes are connected to the liquid pipe connection portion 53*a* and the gas pipe connection portion 54*a* by welding, flare nuts or the like.

The indoor expansion valve 52*a* is provided on the indoor unit liquid pipe 71*a*. The indoor expansion valve 52*a* is an electronic expansion valve, and when the indoor heat exchanger 51*a* functions as an evaporator, that is, that is, when the indoor unit 5*a* performs heating operation, the degree of opening thereof is adjusted such that the refrigerant supercooling degree at the refrigerant exit (the side of the liquid pipe connection portion 53*a*) of the indoor heat exchanger 51*a* is a target refrigerant supercooling degree. Here, the target refrigerant supercooling degree is a refrigerant supercooling degree for sufficient heating ability to be displayed at the indoor unit 5*a*. When the indoor heat exchanger 51*a* functions as a evaporator, that is, when the indoor unit 5*a* performs cooling operation, the degree of opening of the indoor expansion valve 52*a* is adjusted such that the refrigerant superheating degree at the refrigerant exit (the side of the gas pipe connection portion 54*a*) of the indoor heat exchanger 51*a* is an average refrigerant super-cooling degree described later.

The indoor fan 55*a* is made of a resin material, and disposed in the neighborhood of the indoor heat exchanger 51*a*. The indoor fan 55*a* is rotated by a non-illustrated fan motor to thereby take the indoor air into the indoor unit 5*a* from a non-illustrated inlet, and supplies the indoor air heat-exchanged with the refrigerant at the indoor heat exchanger 51*a* from a non-illustrated outlet into the room.

In addition to the above-described components, various sensors are provided in the indoor unit 5*a*. Between the indoor heat exchanger 51*a* and the indoor expansion valve 52*a* on the indoor unit liquid pipe 71*a*, a liquid side temperature sensor 61*a* that detects the temperature of the refrigerant flowing into the indoor heat exchanger 51*a* or flowing out from the indoor heat exchanger 51*a* is provided. The indoor unit gas pipe 72*a* is provided with a gas side temperature sensor 62*a* that detects the temperature of the refrigerant flowing out from the indoor heat exchanger 51*a* or flowing into the indoor heat exchanger 51*a*. In the neighborhood of a non-illustrated inlet of the indoor unit 5*a*, an inflow temperature sensor 63*a* that detects the temperature of the indoor air flowing into the indoor unit 5*a*, that is, the inflow temperature is provided.

The indoor unit 5*a* is provided with an indoor unit controller 500*a*. The indoor unit controller 500*a* is mounted on a control board housed in a non-illustrated electric component box of the indoor unit 5*a*, and as shown in FIG. 1B, is provided with a CPU 510*a*, a storage unit 520*a*, a communication unit 530*a* and a sensor input unit 540*a*.

The storage portion 520*a* is formed of a ROM and a RAM, and stores a control program of the indoor unit 5*a*, detection values corresponding to detection signals from various sensors, setting information related to an air-conditioning operation by the user, and the like. The communication portion 530*a* is an interface that performs communication with the outdoor unit 2 and the other indoor units 5*b*, 5*c*. The sensor input portion 540*a* receives the results of the detections at the sensors of the indoor unit 5*a* and outputs them to the CPU 510*a*.

The CPU 510*a* receives the above-mentioned results of the detections at the sensors of the indoor unit 5*a* through the sensor input unit 540*a*. Moreover, the CPU 510*a* receives, through a non-illustrated remote control light receiving portion, a signal containing operation information, timer operation setting and the like set by the user operating a non-illustrated remote control unit. Moreover, the CPU 510*a* transmits an operation start/stop signal and a control signal containing operation information (the set temperature, the room temperature, etc.) to the outdoor unit 2 through the communication portion 530*a*, and receives a signal containing information such as a temperature of the outside air detected by the outdoor unit 2 from the outdoor unit 2 through the communication portion 530*a*. The CPU 510*a* adjusts the degree of opening of the indoor expansion valve 52*a* and controls driving of the indoor fan 55*a* based on the received detection results and the signals transmitted from the remote control unit and the outdoor unit 2.

The above-described outdoor unit controller 200 and the indoor unit controllers 500*a* to 500*c* constitute the controller of the present invention.

The above-described air conditioner 1 is installed in a building 600 shown in FIG. 2. Specifically, the outdoor unit 2 is disposed on the ground; the indoor unit 5*a*, on the first floor; the indoor unit 5*b*, on the second floor: and the indoor unit 5*c*, on the third floor. The outdoor unit 2 and the indoor units 5*a* to 5*c* are interconnected by the above-described liquid pipe 8 and gas pipe 9, and these liquid pipe 8 and gas pipe 9 are buried in a non-illustrated wall or ceiling of the building 600. In FIG. 2, the difference in height between the indoor unit 5*c* installed on the highest floor (the third floor) and the indoor unit 5*a* installed on the lowest floor (the first floor) is represented as H.

Next, the flow of the refrigerant at the refrigerant circuit 100 and the operations of components at the time of the air-conditioning operation of the air conditioner 1 of the present embodiment will be described by using FIG. 1A. In the following description, a case where the indoor units 5*a* to 5*c* perform cooling operation will be described, and detailed description of a case where they perform heating operation is omitted. The arrows in FIG. 1A indicate the flow of the refrigerant at the time of cooling operation.

As shown in FIG. 1A, when the indoor units 5*a* to 5*c* perform cooling operation, the CPU 210 of the outdoor unit controller 200 switches the four-way valve 22 to the state shown by solid lines, that is, such that the port a and the port b of the four-way valve 22 communicate with each other and the port c and the port d communicate with each other. This brings the refrigerant circuit 100 into a heating cycle where the outdoor heat exchanger 23 functions as an condenser and the indoor heat exchangers 51*a* to 51*c* function as evaporators.

The high-pressure refrigerant discharged from the compressor 21 flows through the discharge pipe 41 into the four-way valve 22, and flows from the four-way valve 22 through the refrigerant pipe 43 into the outdoor heat exchanger 23. The refrigerant having flown into the outdoor heat exchanger 23 exchanges heat with the outside air taken into the outdoor unit 2 by the rotation of the outdoor fan 27 and is condensed. The refrigerant having flown out from the outdoor heat exchanger 23 flows from the outdoor unit liquid pipe 44, the outdoor expansion valve 24 the degree of opening of which is fully opened, and the closing valve 25 into the liquid pipe 8.

The refrigerant flowing through the liquid pipe 8 flows into the indoor unit 5*a* to 5*c* through the liquid pipe connection portions 53*a* to 53*c*. The refrigerant having flown into the indoor units 5*a* to 5*c* flows through the indoor unit liquid pipes 71*a* to 71*c*, is decompressed by the indoor expansion valves 52*a* to 52*c*, and flows into the indoor heat exchangers 5*a* to 51*c*. The refrigerant having flown into the indoor heat exchangers 51*a* to 51*c* exchanges heat with the indoor air taken into the indoor units 5*a* to 5*c* by the rotation of the indoor fans 55*a* to 55*c*, and is evaporated. As described above, the indoor heat exchangers 51*a* to 51*c* function as evaporators and the cooled indoor air heat-exchanged with the refrigerant at the indoor heat exchangers 51*a* to 51*c* is flown out form a non-illustrated outlet into the rooms, thereby performing cooling in the rooms where the indoor units 5*a* to 5*c* are installed.

The refrigerant having flown out from the indoor heat exchangers 51*a* to 51*c* flows through the indoor unit gas pipes 72*a* to 72*c*, and flows into the gas pipe 9 through the gas pipe connection portions 54*a* to 54*c*. The refrigerant flowing through the gas pipe 9 flows into the outdoor unit 2 through the closing valve 26. The refrigerant having flown into the outdoor unit 2 flows through the outdoor unit gas pipe 45, the four-way valve 22, the refrigerant pipe 46, the accumulator 28 and the suction pipe 42 in this order, is sucked by the compressor 21 and compressed again.

When the indoor units Sa to 5*c* perform heating operation, the CPU 210 switches the four-way valve 22 to the state shown by the broken line, that is, such that the port a and the port b of the four-way valve 22 communicate with each other and the port b and the port c communicate with each other. This brings the refrigerant circuit 100 into a heating cycle where the outdoor heat exchanger 23 functions as a evaporator and the indoor heat exchangers 51*a* to 51*c* function as condensers.

Figure 3:
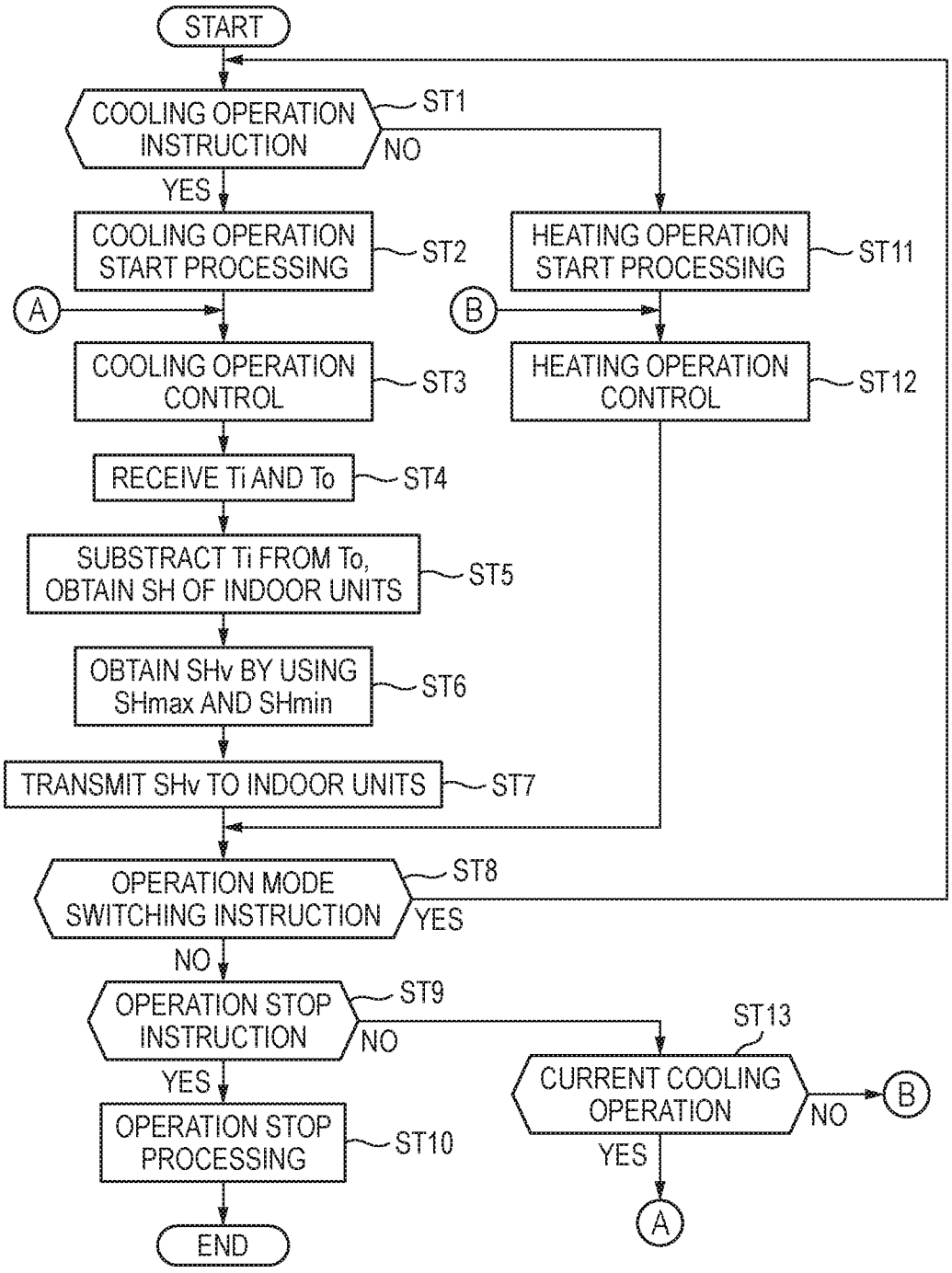
FIG. 3 is a flowchart explaining processing at the outdoor controller in the embodiment of the present invention.

Next, the operation, workings and effects of the refrigerant circuit related to the present invention in the air conditioner 1 of the present embodiment will be described by using FIGS. 1 to 3. When the indoor heat exchangers 51*a* to 51*c* function as evaporators, liquid side temperature sensors 61*a* to 61*c* that detect the heat exchange entrance temperature, which is the temperature of the refrigerant flowing into the indoor heat exchangers 51*a* to 51*c*, and gas side temperature sensors 62*a* to 62*c* that detect the heat exchange exit temperature, which is the temperature of the refrigerant flowing out from the indoor heat exchangers 51*a* to 51*c*, the outdoor unit controller 200, the indoor unit controllers 500*a* to 500*c* are superheating degree detectors.

As described above using FIG. 2, in the air conditioner 1 of the present embodiment, the outdoor unit 2 is installed on the ground of the building 600 and the indoor units 5*a* to 5*c* are installed on the floors, respectively. That is, the outdoor unit 2 is installed in a lower position than the indoor units 5*a* to 5*c*, and there is a height difference H between the installation locations of the indoor unit 5*a* and the indoor unit 5*c*. In this case, the following problem arises when cooling operation is performed by the air conditioner 1.

In cooling operation, the gas refrigerant discharged from the compressor 21 flows from the discharge pipe 41 into the outdoor heat exchanger 23 through the four-way valve 22 and the refrigerant pipe 43, exchanges heat with the outside air in the outdoor heat exchanger 23, is condensed, and becomes the liquid refrigerant. At this time, since the outdoor unit 2 is installed in the lower position than the indoor units 5*a* to 5*c*, the liquid refrigerant condensed at the outdoor heat exchanger 23 and having flown out into the liquid pipe 8 flows through the liquid pipe 8 against gravity toward the indoor units 5*a* to 5*c*.

Therefore, it becomes more difficult for the liquid refrigerant having flown out into the liquid pipe 8 to flow toward the indoor units 5*a* to 5*c* as the installation positions of the indoor units 5*a* to 5*c* become high compared with that of the outdoor unit 2. When there is a height difference H in the installation positions of indoor units 5*a* to 5*c*, the pressure of the refrigerant on the upstream side (the side of the outdoor unit 2) of the indoor expansion valve 52*c* of the indoor unit 5*c* installed on the third floor is lower than the pressure of the refrigerant on the upstream side of the indoor expansion valves 52*a*, 52*h* of the indoor units 5*a*, 5*b* installed on the other floors. For this reason, a difference between the refrigerant pressure on the upstream side of the indoor expansion valve 52*c* of the indoor unit 5*c* and the refrigerant pressure on the downstream side thereof (the side of the indoor heat exchanger 51*c*) is small compared with a difference between the refrigerant pressure on the upstream side of the indoor expansion valves 52*a*, 52*b* of the indoor units 5*a*, 5*b* and the refrigerant pressure on the downstream side thereof.

In the state of the refrigerant circuit 100 as described above, the smaller the difference between the refrigerant pressure on the upstream side of the indoor expansion valves 52*a* to 52*c* and the refrigerant pressure on the downstream side thereof, the smaller the amounts of refrigerant passing through the indoor expansion valves 52*a* to 52*c*. Therefore, the amount of refrigerant flowing through the indoor unit 5*c* installed on the third floor is small compared with the amounts of refrigerant flowing in the other indoor units 5*a*, 5*b*. This becomes more conspicuous as the height difference H between the indoor unit 5*a* installed on the first floor (the lowest position) and the indoor unit 5*c* installed on the third floor (the highest position) increases. That is, as the height difference becomes larger, the liquid refrigerant flowing out from the outdoor unit 2 into the liquid pipe 8 becomes harder to flow toward the indoor unit 5*c*, and the amount of refrigerant flowing into the indoor unit 5*c* is smaller compared with the amounts of refrigerant flowing into the indoor units 5*a*, 5*b*.

If the height difference between the indoor unit 5*a* and the indoor unit 5*c* is equal to or greater than a certain value (for example, 50 m), the amount of refrigerant flowing into the indoor unit 5*c* may be insufficient for the amount of refrigerant required to display the required cooling ability. At this time, even if the degree of opening of the indoor expansion valve 52*c* is increased in order to increase the amount of refrigerant flowing into the indoor unit 5*c*, since the amount of refrigerant flowing from the outdoor unit 2 toward the indoor unit 5*c* is insufficient in the first place, the amount of refrigerant flowing into the indoor unit 5*c* does not increase, and there is a problem that a state in which the cooling ability cannot be exhibited cannot be eliminated.

Accordingly, in the present invention, when the air conditioner 1 performs cooling operation, the refrigerant superheating degree on the refrigerant exit side of the indoor heat exchangers 51*a* to 51*c* of the indoor units 5*a* to 5*c* (the side of gas side closing valves 54*a* to 54*c*) is calculated periodically (for example, every thirty seconds), the maximum value and the minimum value of the calculated refrigerant superheating degrees are extracted, and an average refrigerant superheating degree which is the average value of these is obtained. Then, a refrigerant amount balance control is executed in which the degrees of opening of the indoor expansion valves 52*a* to 52*c* of the indoor units 5*a* to 5*c* are adjusted so that the refrigerant superheating degree on the refrigerant exit side of the indoor heat exchangers 51*a* to 51*c* becomes the obtained average refrigerant superheating degree.

As described above, even if the indoor expansion valve 5*c* is enlarged, when the refrigerant does not flow to the indoor unit 5*c* and the amount of refrigerant is insufficient and no cooling ability is not displayed at the indoor unit 5*c*, the refrigerant superheating degrees of the indoor units 5*a* to 5*c* increase as the installation positions thereof become higher from the outdoor unit 2 such as 1 deg. in the indoor unit 5*a*, 2 deg. in the indoor unit 5*b* and 11 deg., in the indoor unit 5*c*. While the refrigerant superheating degree has a large value due to the insufficient amount of refrigerant in the indoor unit 5*c*, in the indoor units 5*a* and 5*b*, the amounts of refrigerant are larger than that of the indoor unit 5*c*, which indicates that the refrigerant superheating degree is a small value. That is, it indicates that the refrigerant distribution in each of the indoor units 5*a* to 5*c* is biased in the refrigerant circuit 100 during cooling operation.

If the refrigerant amount balance control is executed when the refrigerant distribution in each of the indoor units 5*a* to 5*c* is biased during the cooling operation, in the indoor units 5*a*, 5*b* whose refrigerant superheating degrees are smaller than the average refrigerant superheating degree (in the case of the above example, 6 deg. which is an average value of the maximum value: 11 deg. and the minimum value: 1 deg.), the degrees of opening of the indoor expansion valves 52*a*, 52*b* are narrowed in order to raise the refrigerant superheating degree to the average refrigerant superheating degree. Accordingly, the amounts of refrigerant flowing into the indoor units 5*a*, 5*b* are reduced, and the refrigerant pressure on the downstream side (sides of indoor heat exchangers 51*a*, 51*b*) of the indoor expansion valves 52*a*, 52*b* is reduced.

On the other hand, in the indoor unit 5*c* where the refrigerant superheating degree is higher than the average refrigerant superheating degree, since the refrigerant pressure on the downstream side of the indoor expansion valves 52*a*, 52*b* decreases and this decreases the refrigerant pressure on the downstream side of the indoor expansion valve 52*c*, the difference in pressure between the upstream side and the downstream side of the indoor expansion valve 52*c* increases. Accordingly, in order to reduce the refrigerant superheating degree of the indoor unit 5*c* to the average refrigerant superheating degree in the refrigerant amount balance control, when the degree of opening of the indoor expansion valve 52*c* is increased, the amount of refrigerant passing through the indoor expansion valve 52 increases, that is, the amount of refrigerant flowing into the indoor unit 5*c* increases, so that the cooling ability of the indoor unit 5*c* increases.

Next, the control at the time of cooling operation in the air conditioner 1 of the present embodiment will be described by using FIG. 3. FIG. 3 shows the flow of the processing related to the control performed by the CPU 210 of the outdoor unit controller 200 when the air conditioner 1 performs cooling operation. In FIG. 3, ST represents a step, and the number following this represents a step number. In FIG. 3, the processing related to the present invention is mainly described, and description of processing other than this, for example, general processing related to the air conditioner 1 such as control of the refrigerant circuit 100 corresponding to the operation conditions such as the set temperature and air volume specified by the user is omitted. In the following description, a case where all the indoor units 5*a* to 5*c* are performing cooling operation will be described as an example.

In the following description, the heat exchange entrance temperatures, which are the refrigerant temperature at the refrigerant entrance side of the indoor heat exchangers 51*a* to 51*c* detected by the liquid side temperature sensors 61*a* to 61*c* of the indoor units 5*a* to 5*c*, are set as Ti (unit: ° C. When referring to the indoor units 5*a* to 5*c* individually, Tia to Tic), the heat exchange exit temperatures, which are the refrigerant temperature at the refrigerant exit side of the indoor heat exchangers 51*a* to 51*c* detected by the gas side temperature sensors 62*a* to 62*c* of the indoor units 5*a* to 5*c*, are set as To (unit: ° C. When referring to the indoor units 5*a* to 5*c* individually, Toa to Toc), the refrigerant superheating degrees in the indoor units 5*a* to 5*c* obtained by subtracting the heat exchange entrance temperatures Ti from the heat exchange exit temperatures To are set as SH (unit: deg. When referring to the indoor units 5*a* to 5*c* individually, SHa to SHc), a maximum refrigerant superheating degree which is the maximum value among the refrigerant superheating degrees SH of the indoor units 5*a* to 5*c* is set as SHmax, and a minimum refrigerant superheating degree which is the minimum value of the refrigerant superheating degrees SH of the indoor units 5*a* to 5*c* is set as SHmin, and an average refrigerant superheating degree obtained by averaging the maximum refrigerant superheating degree SHmax and the minimum refrigerant superheating degree SHmin is set as SHv.

First, the CPU 210 determines whether the user's operation instruction is a cooling operation instruction or not (ST1).

When it is not a cooling operation instruction (ST1—No), the CPU 210 executes heating operation start processing which is the processing to start heating operation (ST11). Here, the heating operation start processing is that the CPU 210 operates the four-way valve 22 to bring the refrigerant circuit 100 into the heating cycle, and is the processing performed when the heating operation is started from the state where the air conditioner 1 is stopped, or when the cooling operation is switched from the cooling operation to the heating operation.

Then, the CPU 210 starts the compressor 21 and the outdoor fan 27 at predetermined rpm, instructs the indoor units 5*a* to 5*c*, through the communication unit 230, to control driving of the indoor fans 55*a* to 55*c* and adjust the degrees of opening of the indoor expansion valves 52*a* to 52*c* to thereby start control of heating operation (ST12), and advances the process to ST8.

At ST1, when it is a cooling operation instruction (ST1—Yes), the CPU 210 executes cooling operation start processing (ST2). Here, the cooling operation start processing is that the CPU 210 operates the four-way valve 22 to bring the refrigerant circuit 100 into the state shown in FIG. 1A, that is, bring the refrigerant circuit 100 into the cooling cycle, and is the processing performed when the cooling operation is started from the state where the air conditioner 1 is stopped, or when the cooling operation is switched from the heating operation to the cooling operation.

Then, the CPU 210 performs control of the cooling operation (ST3). In the cooling operation start processing, the CPU 210 starts the compressor 21 and the outdoor fan 27 at rpm corresponding to the ability required from the indoor units 5*a* to 5*c*. The CPU 210 fully opens the opening of the outdoor expansion valve 24. Further, the CPU 210 transmits an operation start signal indicating the start of cooling operation to the indoor units 5*a* to 5*c* through the communication unit 230.

The CPUs 510*a* to 510*c* of the indoor unit controllers 500*a* to 500*c* of the indoor units 5*a* to 5*c* having received the operation start signal through the communication units 530*a* to 530*c* start the indoor fans 55*a* to 55*c* at rpm corresponding to the user's air volume instruction. Further, the CPUs 510*a* to 510*c* subtracts the heat exchange entrance temperatures Tia to Tic detected by the liquid side temperature sensors 61*a* to 61*c* from the heat exchange exit temperatures Toa to Toe detected by the gas side temperature sensors 62*a* to 62*c* to obtain the refrigerant superheating degrees SHa to SHc at the refrigerant exit side of the exchangers 51*a* to 51*c* (the side of the gas pipe connection portions 54*a* to 54*c*. The opening degrees of the indoor expansion valves 52*a* to 52*c* are adjusted such that the obtained refrigerant superheating degrees SHa to SHc become the target refrigerant superheating degree (for example, 4 deg.) at the start of operation.

Here, the target refrigerant superheating degree is a value previously obtained by performing a test or the like and stored in the storage units 520*a* to 520*c*, and is a value where it has been confirmed that cooling ability is sufficiently displayed at each indoor unit. During the time from the start of cooling operation to when the state of the refrigerant circuit 100 is stabilized (for example, three minutes from the start of operation), the CPUs 510*a* to 510*c* adjust the degrees of opening of the indoor expansion valves 52*a* to 52*c* such that the refrigerant supercooling degrees become the above-mentioned target refrigerant superheating degree at the time of start of operation.

Then, the CPU 210 receives the heat exchange entrance temperatures Ti (Tia to Tic) and the heat exchange exit temperatures To (Toa to Toc) from the indoor units 5*a* to 5*c* through the communication unit 230 (ST4). The heat exchange entrance temperatures Ti and the heat exchange exit temperatures To are the detection values at the liquid side temperature sensors 61*a* to 61*c* and the gas side temperature sensors 62*a* to 6*sc* that the CPUs 510*a* to 510*c* receive at the indoor units 5*a* to 5*c* and transmit to the outdoor unit 2 through the communication units 530*a* to 530*c*. The above-mentioned detection values are received by the CPU 210 and the CPUs 510*a* to 510*c* every predetermined time (for example, every 30 seconds) and stored in the storage unit 210 and the storage units 520*a* to 520*c*.

Next, the CPU 210 subtracts the heat exchange entrance temperature Ti from the heat exchange exit temperature Tb of each of the indoor units 5*a* to 5*c* received at ST4, and obtains the refrigerant superheating degrees SH of the indoor units 5*a* to 5*c* (ST5). Specifically, the CPU 210 subtracts the heat exchange entrance temperature Tia from the heat exchange exit temperature Toa of the indoor unit 5*a* to obtain the refrigerant superheating degree SHa, associates this with the indoor unit 5*a*, and stores it in the storage unit 220. Similarly, the CPU 210 obtains the refrigerant superheating degrees SHb, SHc for the indoor unit 5*b* and the indoor unit 5*c*, associates these with the indoor units 5*b* or 5*c*, and stores them in the storage unit 220.

Next, the CPU 210 sets the maximum value of the refrigerant superheat degrees SHa to SHc of the indoor units 5*a* to 5*c* obtained in ST5 as the maximum refrigerant superheating degree SHmax and the minimum value as the minimum refrigerant superheating degree SHmin, and the maximum refrigerant superheating degree SHmax and the minimum refrigerant superheating degree SHmin are averaged to obtain the average refrigerant superheating degree SHv (ST6). The average refrigerant superheating degree SHv is an arithmetic average value of the maximum refrigerant superheating degree SHmax and the minimum refrigerant superheating degree SHmin: [maximum refrigerant superheating degree SHmax+minimum refrigerant superheating degree SHmin]/2.

Then, the CPU 210 transmits the average refrigerant superheating degree SHv obtained at ST6 to the indoor units 5*a* to 5*c* through the communication unit 230 (ST7). The CPUs 510*a* to 510*c* of the indoor units 5*a* to 5*c* having received the average refrigerant superheating degree SHv through the communication units 530*a* to 530*c* obtain the refrigerant superheating degrees SHa to SHc by subtracting the heat exchange entrance temperatures Tia to Tic detected by the liquid side temperature sensors 61*a* to 61*c* from the heat exchange exit temperature Toa to Toc detected by the gas side temperature sensors 62*a* to 62*c*, and adjust the degrees of opening of the indoor expansion valves 52*a* to 52*c* such that the obtained refrigerant superheating degrees SHa to SHc become the average refrigerant superheating degree SHv received from the outdoor unit 2.

The above-described processing from ST4 to ST7 is the processing related to the refrigerant amount balance control of the present invention.

The CPU 210 having finished the processing of ST7 determines whether there is an operation mode switching instruction by the user or not (ST8). Here, the operation mode instruction is an instruction to switch from the current operation (in this description, cooling operation) to another operation (heating operation). When there is an operation mode switching instruction (ST8—Yes), the CPU 210 returns the process to ST1. When there is no operation mode switching instruction (ST8—No), the CPU 210 determines whether there is an operation stop instruction by the user or not (ST9). The operation stop instruction is an instruction to stop the operation of all the indoor units 5*a* to 5*c*.

When there is an operation stop instruction (ST9—Yes), the CPU 210 executes operation stop processing (ST10), and ends the process. In the operation stop processing, the CPU 210 stops the compressor 21 and the outdoor fan 27 and fully closes the outdoor expansion valve 24. Moreover, the CPU 210 transmits an operation stop signal indicative of the stop of operation to the indoor units 5*a* to 5*c* through the communication unit 230. The CPUs 510*a* to 510*c* of the indoor units 5*a* to 5*c* having received the operation stop signal through the communication units 530*a* to 530*c* stop the indoor fans 55*a* to 55*c* and fully close the indoor expansion valves 52*a* to 52*c*.

When there is no operation stop instruction at ST9 (ST9—No), the CPU 210 determines whether the current operation is cooling operation or not (ST13). When the current operation is heating operation (ST13—Yes), the CPU 210 returns the process to ST3. When the current operation is not heating operation (ST13—No), that is, when the current operation is heating operation, the CPU 210 returns the process to ST12.

Second Embodiment

Next, a second embodiment of the present invention will be described by using mainly FIG. 4. What is different from the first embodiment is that in the second embodiment, the refrigerant amount balance control is started from the point of time when it is determined that there is an indoor unit where cooling ability required by the user cannot displayed, whereas in the first embodiment, the refrigerant amount balance control is executed from the time of start of cooling operation (precisely, from when the refrigerant circuit 100 is stabilized). Detailed description of points other than this, that is, the components of the air conditioner 1 and the state of the refrigerant circuit 100 at the time of cooling operation is omitted since it is the same as that of the first embodiment.

As described in the first embodiment, if the refrigerant amount balance control is executed, in the indoor unit where the refrigerant superheating degree is higher than the average refrigerant superheating degree of the indoor units 5*a* to 5*c* (in the first embodiment, the indoor unit 5*c*), the amount of refrigerant flowing into the indoor unit increases and cooling ability increases. On the other hand, in the indoor unit where the refrigerant superheating degree is lower than the average refrigerant superheating degree (in the first embodiment, the indoor units 5*a*, 5*b*), the amount of the refrigerant flowing into the indoor unit decreases compared with when the refrigerant amount balance control is not performed, and cooling ability decreases. That is, in order that cooling ability is displayed in the indoor unit 5*c* installed above where the required cooling ability cannot be displayed, cooling ability is decreased in the indoor units 5*a*, 5*b* installed below the indoor unit 5*c*.

In the first embodiment, the refrigerant amount balance control is executed from the time of start of cooling operation. Consequently, the refrigerant amount balance control is executed irrespective of whether there is an indoor unit where the required cooling ability cannot be displayed or not. If the refrigerant amount balance control is executed when there is no indoor unit where the required cooling ability cannot be displayed, cooling ability is unnecessarily decreased in the indoor unit where cooling ability is displayed.

On the contrary, in the second embodiment, whether there is an indoor unit where the required cooling ability cannot be displayed or not is determined by a method described below, and the refrigerant amount balance control is executed only when there is an indoor unit. Accordingly, while the cooling ability of the indoor unit where the required cooling ability cannot be displayed is prevented from being decreased unnecessarily at the time of cooling operation, when there is an indoor unit where the required heating ability cannot be displayed, the cooling ability of the indoor unit can be increased.

The determination as to the presence or absence of an indoor unit where the required cooling ability cannot be displayed is performed as follows. First, the CPU 210 of the outdoor unit 2 obtains the maximum refrigerant superheating degree SHmax and the minimum refrigerant superheating degree SHmin in the same manner as the method described in the first embodiment. If a refrigerant superheating degree difference (hereinafter, described as refrigerant superheating degree difference SIM (unit: deg.)) which is the difference between the maximum refrigerant superheating degree SHmax and the minimum refrigerant superheating degree SHmin is equal to or greater than a predetermined threshold superheating degree difference (for example, 8 deg., hereafter, described as threshold superheating degree difference SHTs (unit: deg.)), it is determined that the cooling ability required by the indoor unit having the maximum refrigerant superheating degree SHmax cannot be displayed.

Here, the threshold superheating degree difference SHTs is previously tested or the like and stored in the storage unit 220 of the outdoor unit controller 200, and if the refrigerant superheating degree difference SHd is equal to or greater than the threshold superheating degree difference SHTs, it is a value which determines that the cooling capacity required by the indoor unit having the maximum refrigerant superheating degree SHmax cannot be exhibited, and the amount of refrigerant flowing into the indoor unit is insufficient.

Next, the control at the time of cooling operation in the air conditioner 1 of the present embodiment will be described by using FIG. 4. FIG. 4 shows the flow of the processing related to the control performed by the CPU 210 of the outdoor unit controller 200 when the air conditioner 1 performs cooling operation. In FIG. 4, ST represents a step, and the number following this represents the step number. In FIG. 4, the processing related to the present invention is mainly described, and description of processing other than this, for example, general processing related to the air conditioner 1 such as control of the refrigerant circuit 100 corresponding to the operation conditions such as the set temperature and air volume specified by the user is omitted. In the following description, a case where all the indoor units 5*a* to 5*c* are performing cooling operation will be described as an example as in the first embodiment.

Figure 4:
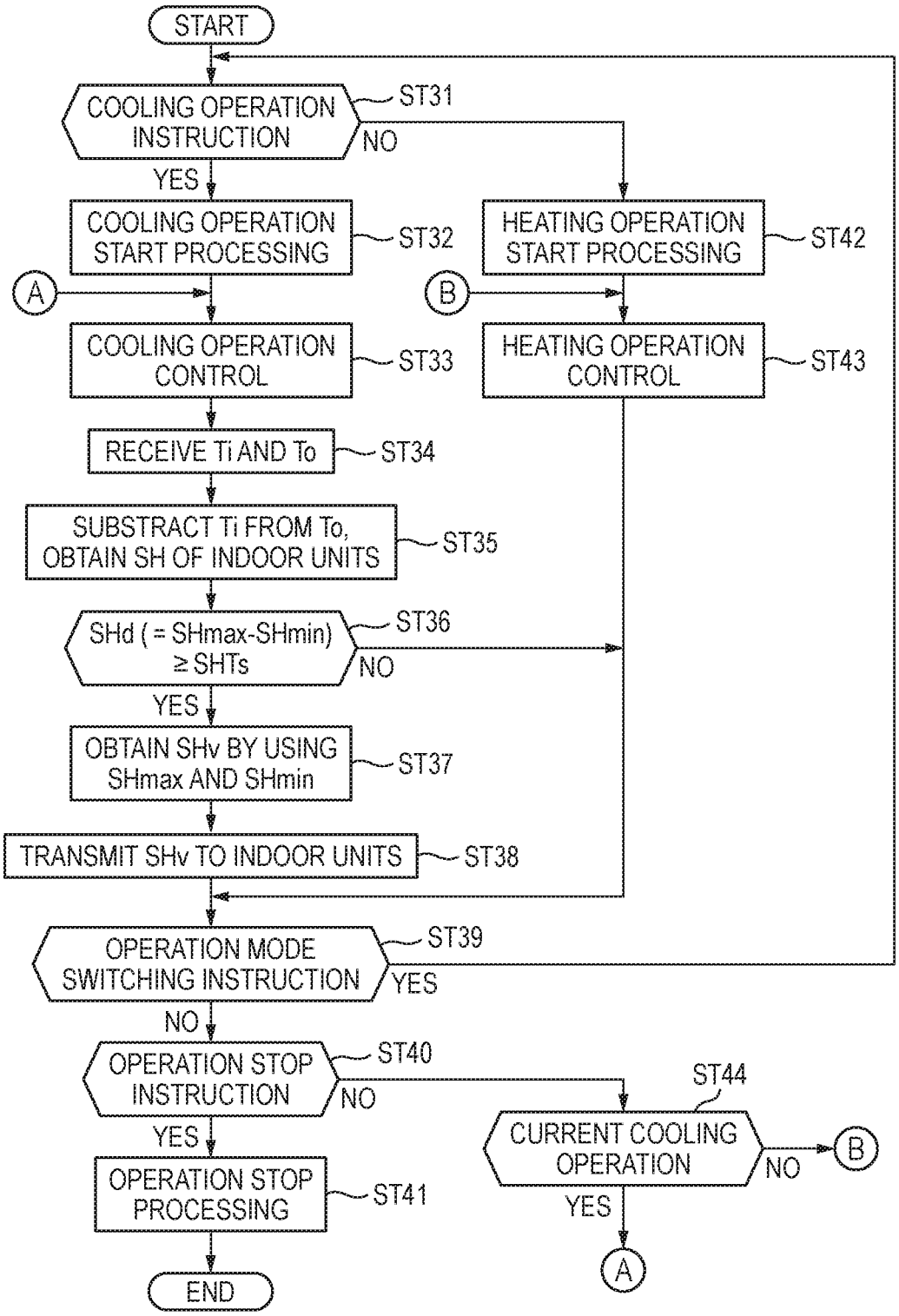
FIG. 4 is a flowchart explaining processing at the outdoor unit controller in another embodiment of the present invention.

Since the flowchart shown in FIG. 4 is the same processing as the flowchart shown in FIG. 3 described in the first embodiment except the processing of ST36, detailed description thereof is omitted, and only the processing of ST36 will be described here.

The CPU 210 that has finished the processing of ST34 (corresponding to ST4 in the first embodiment) and ST35 (corresponding to ST5 in the first embodiment) sets the maximum value as the maximum refrigerant superheating degree SHmax and the minimum value as the minimum refrigerant superheating degree SHmin among the refrigerant superheating degrees SHa to SHc of the indoor units 5*a* to 5*c* obtained in ST35, and determines whether the refrigerant superheating degree difference SHd obtained by subtracting the minimum refrigerant superheating degree SHmin from the maximum refrigerant superheating degree SHmax is equal to or greater than the threshold superheating degree difference SHTs (ST36).

If the refrigerant superheating degree difference SHd is not equal to or greater than the threshold superheating degree difference SHTs (ST36—No), the CPU 210 determines that it is not necessary to execute the refrigerant amount balance control, and advances the process to ST39. On the other hand, if the refrigerant superheating degree difference SHId is equal to or greater than the threshold superheating degree difference SHTs (ST36—Yes), the CPU 210 determines that it is necessary to execute the refrigerant amount balance control, executes the processing of ST37 (corresponding to ST6 in the first embodiment) and ST38 (corresponding to ST7 in the first embodiment), and advances the process to ST39.

The above-described processing from ST34 to ST38 is the processing related to the refrigerant amount balance control in the second embodiment of the present invention.

As described above, the air conditioner 1 of the present invention executes the refrigerant amount balance control to adjust the degrees of opening of the indoor expansion valves 52*a* to 52*c* such that the refrigerant superheating degrees SHa to SHc in the indoor units 5*a* to 5*c* at the time of cooling operation become an average refrigerant superheating degree SHv obtained by averaging the maximum refrigerant superheating degree SHmax and the minimum refrigerant superheating degree SHmin among them. Accordingly, since the amount of refrigerant flowing into the indoor unit where the cooling ability cannot be displayed due to the shortage of the amount of refrigerant flowing thereinto, the cooling ability of the indoor unit is increased.

Although the invention has been described in detail with reference to specific embodiments, it will be apparent to those skilled in the art that various changes and modifications can be made without departing from the spirit and scope of the invention.

REFERENCE SIGNS LIST

1 air conditioner
2 outdoor unit
5*a*~5*c* indoor unit
51*a*~51*c* indoor heat exchanger
52*a*~52*c* indoor expansion valve
61*a*~61*c* liquid side temperature sensor
62*a*~62*c* gas side temperature sensor
100 refrigerant circuit
200 outdoor unit controller
210 CPU
500*a*~500*c* indoor unit controller
510*a*~510*c* CPU
SH refrigerant superheating degree
SHv average refrigerant superheating degree
SHmax maximum refrigerant superheating degree
SHmin minimum refrigerant superheating degree
SHd refrigerant superheating degree difference
SHTs threshold superheating degree difference
Ti heat exchange entrance temperature
To heat exchange exit temperature

The invention claimed is:

1. An air conditioner comprising:

an outdoor unit which includes an outdoor heat exchanger and an outdoor expansion valve;

a plurality of indoor units each of which includes an indoor heat exchanger and an indoor expansion valve;

a superheating degree detector which includes liquid side and gas side temperature sensors, and detects a refrigerant superheating degree which is a superheating degree of a refrigerant flowing out from each indoor heat exchanger when each indoor heat exchanger is functioning as an evaporator; and a controller which adjusts degrees of opening of the plurality of indoor expansion valves, wherein the controller obtains a refrigerant superheating degree difference which is a difference between a maximum value and a minimum value of the refrigerant superheating degrees of the indoor units such that the refrigerant superheating degree on a refrigerant exit side of each indoor heat exchanger becomes an average refrigerant superheating degree obtained by averaging the maximum value and the minimum value of the refrigerant superheating degrees detected by the superheating degree detector, wherein if the obtained refrigerant superheating degree difference is greater than a predetermined threshold superheating degree difference, the controller determines whether there is an indoor unit where cooling ability required by the plurality of indoor units is not displayed or not, and wherein when there is an indoor unit where the required heating ability cannot be displayed, the controller executes the refrigerant amount balance control to adjust the degree of opening of each indoor expansion valve.

* * * * *